US008662490B2

(12) United States Patent
Clauser et al.

(10) Patent No.: US 8,662,490 B2
(45) Date of Patent: Mar. 4, 2014

(54) BULK DOCUMENT FEEDER WITH REMOVABLE CARTRIDGE

(75) Inventors: Robert J. Clauser, Columbus, NJ (US); John D. Snider, West Chester, PA (US); Kenneth B. Wood, Romansville, PA (US); Edward M. Zoladz, Jr., West Chester, PA (US); Carl Alexander Phillips, West Chester, PA (US)

(73) Assignee: MEI, Inc., Malvern, PA (US)

( * ) Notice: Subject to any disclaimer, the term of this patent is extended or adjusted under 35 U.S.C. 154(b) by 737 days.

(21) Appl. No.: 12/439,916

(22) PCT Filed: Sep. 4, 2007

(86) PCT No.: PCT/US2007/077549

§ 371 (c)(1),
(2), (4) Date: Aug. 10, 2010

(87) PCT Pub. No.: WO2008/030819

PCT Pub. Date: Mar. 13, 2008

(65) Prior Publication Data

US 2010/0289208 A1 Nov. 18, 2010

Related U.S. Application Data

(60) Provisional application No. 60/824,512, filed on Sep. 5, 2006.

(51) Int. Cl.
*B65H 5/22* (2006.01)
*G07F 7/04* (2006.01)

(52) U.S. Cl.
USPC ..... 271/3.14; 194/206; 194/207; 194/350

(58) Field of Classification Search
USPC ..... 194/206, 207, 350; 271/3.01, 3.14, 271/177–181; 209/534
See application file for complete search history.

(56) References Cited

U.S. PATENT DOCUMENTS

| | | | | |
|---|---|---|---|---|
| 4,500,084 | A * | 2/1985 | McInerny | 271/35 |
| 4,653,647 | A | 3/1987 | Hashimoto | |
| 4,884,698 | A | 12/1989 | Tutamune et al. | |
| 4,889,220 | A | 12/1989 | Yoshinori et al. | |
| 4,905,840 | A | 3/1990 | Yuge et al. | |

(Continued)

FOREIGN PATENT DOCUMENTS

EP 1 544 806 A2 6/2005

OTHER PUBLICATIONS

"JCM Maintenance Guide: AZTEC™ BNF-2000 Bill Acceptor," Part No. 960-100176R_Rev.1, JCM American Corp. pp. 1-28 (2007).

(Continued)

*Primary Examiner* — Luis A Gonzalez
(74) *Attorney, Agent, or Firm* — Mintz Levin Cohn Ferris Glovsky and Popeo, P.C.

(57) ABSTRACT

A bulk document feeder module is adapted for connection to a document acceptor and is operable, when attached to the document acceptor, to feed one document at a time, from a bundle of documents, to the document acceptor. The bulk document feeder module can include a document transport mechanism, a portion of which includes a removable cartridge, to facilitate removal of a jammed object from the feeder module. The document acceptor can form part of a bill or other document validator.

26 Claims, 14 Drawing Sheets

(56) References Cited

U.S. PATENT DOCUMENTS

| | | | | |
|---|---|---|---|---|
| 5,096,067 | A | 3/1992 | Tutamune et al. | |
| 5,394,992 | A | 3/1995 | Winkler | |
| 5,468,941 | A | 11/1995 | Sasaki | |
| 5,692,067 | A | 11/1997 | Raterman et al. | |
| 5,704,491 | A | 1/1998 | Graves | |
| 5,806,650 | A | 9/1998 | Mennie et al. | |
| 5,815,592 | A | 9/1998 | Mennie et al. | |
| 6,220,419 | B1 | 4/2001 | Mennie | |
| 6,357,598 | B1 | 3/2002 | Kimura et al. | |
| 6,378,683 | B2 | 4/2002 | Mennie | |
| 6,398,000 | B1 | 6/2002 | Jenrick et al. | |
| 6,619,461 | B2 * | 9/2003 | Saltsov et al. | 194/317 |
| 6,640,156 | B1 * | 10/2003 | Brooks et al. | 700/213 |
| 6,695,307 | B2 | 2/2004 | Kanagawa | |
| 6,721,442 | B1 | 4/2004 | Mennie et al. | |
| 6,866,134 | B2 | 3/2005 | Stromme et al. | |
| 6,868,954 | B2 | 3/2005 | Stromme et al. | |
| 6,875,259 | B2 | 4/2005 | Letourneau et al. | |
| 6,913,130 | B1 | 7/2005 | Mazur et al. | |
| 6,926,201 | B2 | 8/2005 | Numata | |
| 6,955,253 | B1 | 10/2005 | Mazur et al. | |
| 6,957,733 | B2 | 10/2005 | Mazur et al. | |
| 6,959,800 | B1 | 11/2005 | Mazur et al. | |
| 8,181,852 | B2 * | 5/2012 | Saltsov et al. | 235/379 |
| 2003/0062667 | A1 * | 4/2003 | Saltsov et al. | 271/3.14 |
| 2005/0029168 | A1 | 2/2005 | Jones et al. | |
| 2005/0040005 | A1 | 2/2005 | Dobbins | |
| 2005/0116407 | A1 | 6/2005 | Minamishim et al. | |
| 2006/0021848 | A1 * | 2/2006 | Smith | 194/350 |

OTHER PUBLICATIONS

Aztec™ World Bill Acceptor, Rev # 01072004, JCM Amrican Corporation (2 pages) (2004?).

* cited by examiner

BULK DOCUMENT FEEDER WITH REMOVABLE CARTRIDGE

CROSS-REFERENCE TO RELATED APPLICATION(S)

This application is a national phase filing under 35 U.S.C. §371 of international application number PCT/US2007077549, filed Sep. 4, 2007, which claims the benefit of priority of U.S. Provisional Patent Application No. 60/824,512, filed on Sep. 5, 2006. The contents of the prior applications are incorporated herein by reference.

BACKGROUND

Banknote validators that accept banknotes in bulk can be incorporated, for example, into table-top counting machines or integral systems such as deposit automatic teller machines (ATMs). Such machines typically are designed initially to process bundles of banknotes. Some bill validators are designed to handle one bill at a time.

SUMMARY

The present disclosure relates, in one aspect, to an apparatus that includes a bulk document feeder module adapted for connection to a document acceptor. The bulk document feeder module is operable, when attached to the document acceptor, to feed one document at a time, from a bundle of documents, to the document acceptor.

Some implementations include one or more of the following features. For example, the bulk document feeder module can include a document transport mechanism, a portion of which includes a removable cartridge. The cartridge can be removable, for example, to enable clearing of a jam in a document path.

The apparatus can include a tray to receive a bundle of documents. The tray can be mounted adjacent a front of the bulk document feeder, which is operable to strip one document at a time from the bundle of documents in the tray and to feed the stripped document to the document acceptor.

In some implementations, the bulk document feeder module is mechanically and electrically connected to the document acceptor and includes first and second document paths, a transport mechanism to move a document along one of the document paths depending on whether the document is traveling through the bulk document feeder module in a first direction or a second direction, one or more sensors to detect a status of a document in the bulk document feeder module, and a processor 102 (FIG. 16) to communicate with the document acceptor, to monitor the sensors, and to control the transport mechanism. The bulk document feeder module also includes a diverter having a first position and a second position. When a document is transported in the first direction through the bulk note feeder module, the diverter is operable to move to the second position, and when a document is transported in the second direction, the diverter remains in the first position. The diverter can form part of the removable cartridge.

A related aspect is for a method of upgrading a document validator. The method includes attaching a bulk document feeder module to the document validator, and mechanically and electrically connecting the bulk document feeder module to an acceptor unit of the document validator. In some implementations, the method includes replacing a harness connecting the document validator to a host system to provide power and communication lines to the bulk document feeder module. The method also can include removing a bezel adjacent a document entry of the acceptor unit and mounting an input/output tray adjacent a document entry of the bulk document feeder module.

Another related aspect is for a method of clearing a jam in a bulk document feeder module connected to a document acceptor module installed in safe. The method includes detaching a document input tray, withdrawing a removable cartridge from the bulk document feeder module through an opening in a wall of the safe, clearing a jammed object from the bulk document feeder module, and re-installing the cartridge and the input tray in place in a reversed sequence.

In another aspect, an apparatus includes a document validator operable to detect automatically whether a bulk document feeder module is coupled to the document validator. The validator is operable to operate the bulk document feeder module if it detects one and is adapted to operate as a standalone document validator if not.

According to yet another aspect, an apparatus includes a bulk document feeder module that includes a document separator having a tensioned belt operable to contact an idler wheel when no document is present and having a high-friction wheel. Friction of the high-friction wheel on one side of a document is higher than the friction of the belt on the other side of the document when a document is present between the belt and the wheel.

Any of the apparatus and methods can be adapted for use with banknotes and similar documents.

Other features and advantages will be readily apparent from the detailed description, the accompanying drawings and the claims.

DETAILED DESCRIPTION

The present disclosure relates to a document handling apparatus that includes a bulk document feeder module with a removable cartridge. In some cases, the module is retrofitable to be adapted to a standard bill validator so that, with minimum change to the original validator, notes can be fed from a bundle into the validator, which then processes the notes one at a time. For example, the present disclosure facilitates adapting a bulk document feeder module to an existing MEI, Inc. Cashflow series validator unit.

In the following description, banknotes are used as an example of documents with which the bulk feeder module can be used. The module, however, can be used with other types of documents as well, including, for example, printed coupons, intended to be processed by the acceptor module. More generally, the term "document" includes a substantially flat sheet of value including, but not limited to, banknotes, bank drafts, bills, checks, paper currency, security documents, printed coupons and other similar paper objects of value. Furthermore, a "bundle" of banknotes or other documents is not meant to imply that the banknotes or other documents are fastened together. Rather, a bundle of banknotes or other documents includes any pile of banknotes or other documents stacked one atop another.

Figure 1:
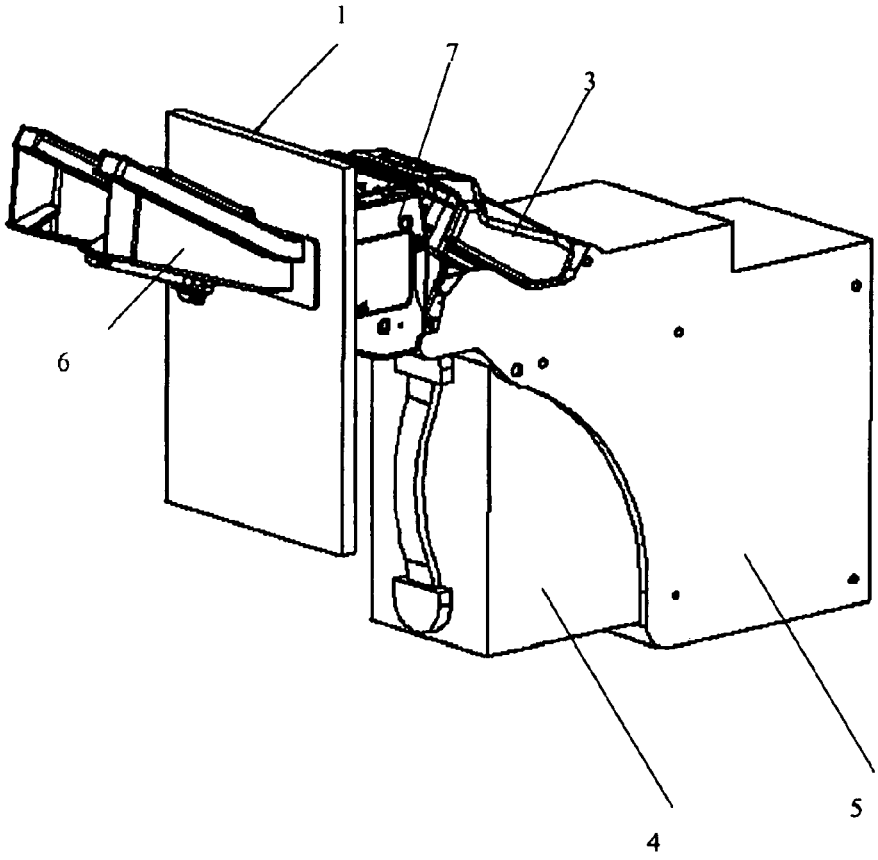
FIG. 1 illustrates an example of a document handling apparatus including a bulk document feeder module according to the invention.
Figure 16:
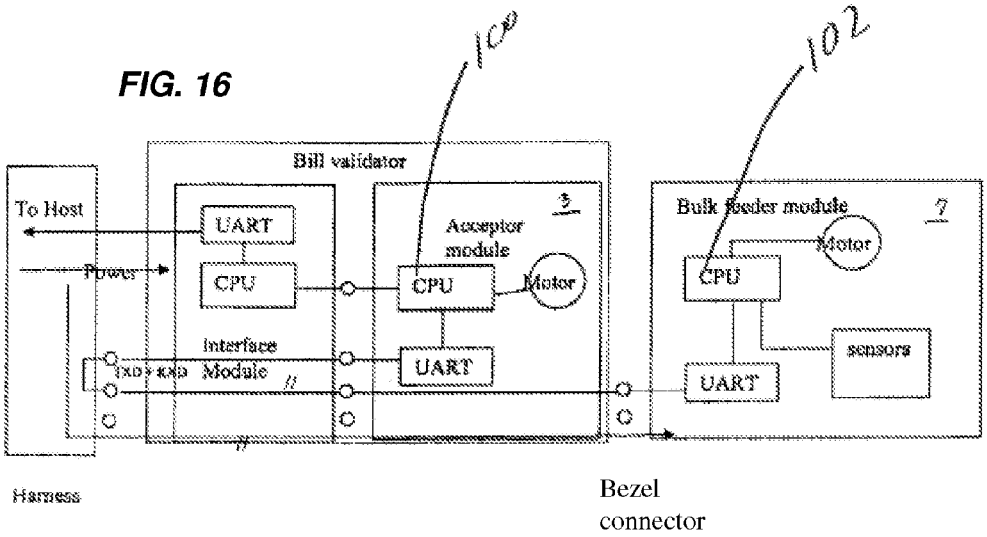
FIG. 16 is a block diagram illustrating interconnections and wiring for the bulk feeder module.

As illustrated in FIGS. 1 and 16, the validator unit includes an acceptor module 3 with control means (e.g., a microprocessor) and validation means (e.g., sensors and associated circuitry), as well as a cash box (sometimes referred to as a cassette) 4 with a stacker mechanism, all of which may be installed in a chassis 5. The acceptor module is coupled to a host system via an interface board (see FIG. 16).

In a typical installation of the retail industry, for example, a validator unit often is installed in a safe, and bills are inserted one-by-one through a bezel (not shown) attached to the door that leads the bill to the validator unit. The safe includes a host system that manages the operation of the safe to which the bill validator is connected. The safe is a generally secure enclosure that includes a secure access door and may contain several bill acceptors with or without a bulk feeder (described below).

Figure 2A:
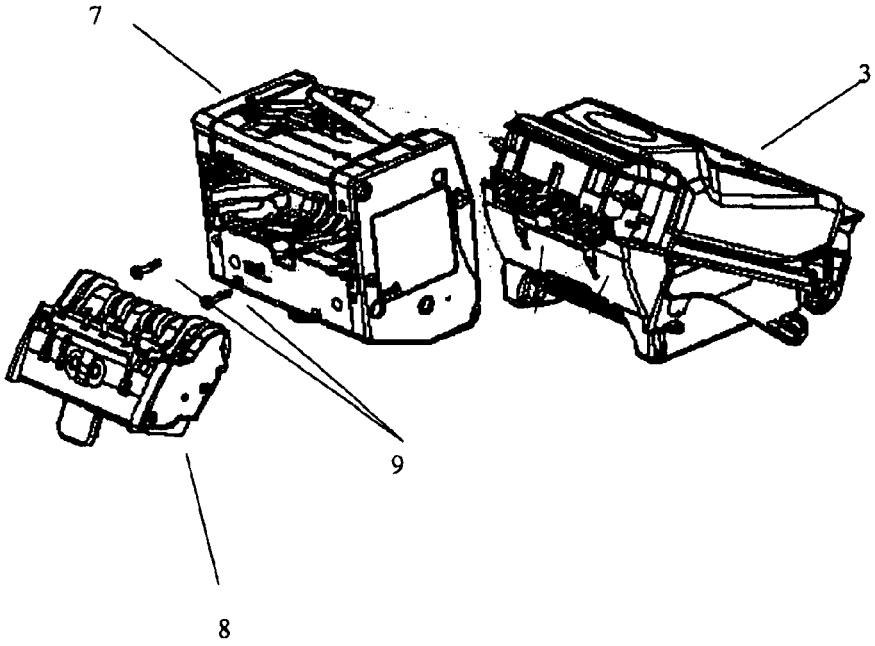
FIG. 2A is an exploded view of a bill validator and bulk feeder module with a removable cartridge.
Figure 2B:
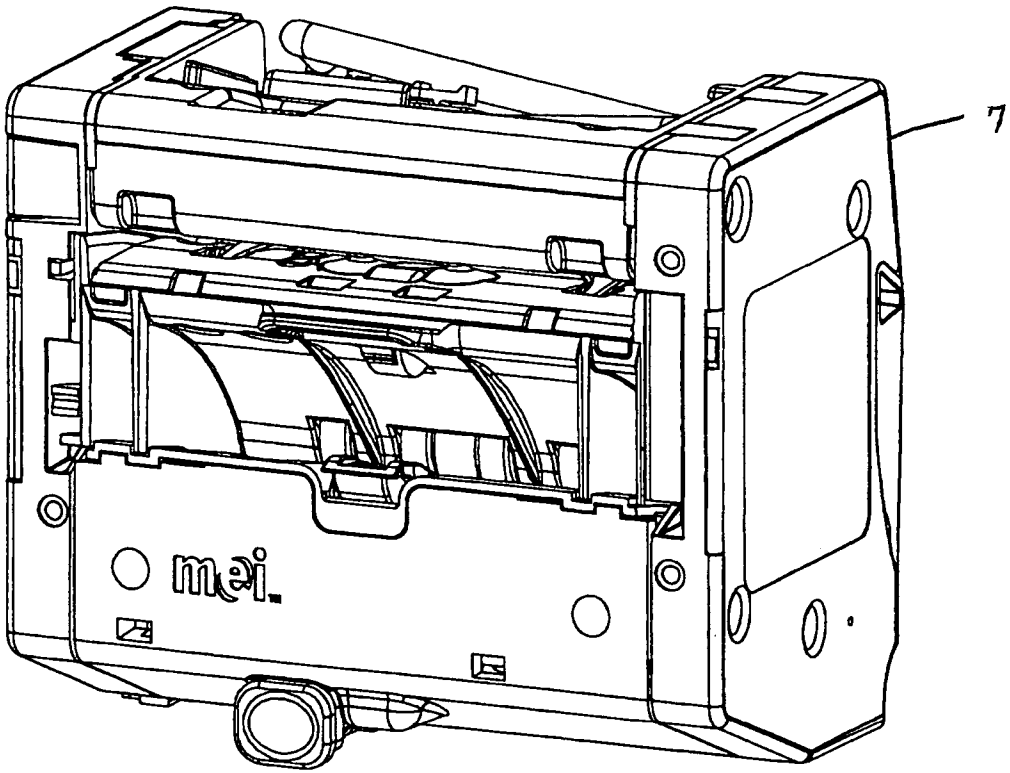
FIG. 2B illustrates a view of the bulk feeder module.

One aspect of the disclosure addresses replacing the standard bezel for the validator unit with a tray that facilitates feeding a bulk of banknotes into the validator unit one note at a time. As shown in the example of FIG. 1, a tray 6 replaces the standard bezel attached to the door 1 of the safe, and a bulk feeder module 7 (see FIG. 2B) is mounted behind the door, between the original validator unit and the door. When installed, the bulk feeder module 7 is connected to the standard bezel connector and the validator unit mechanically and electrically.

Figure 3:
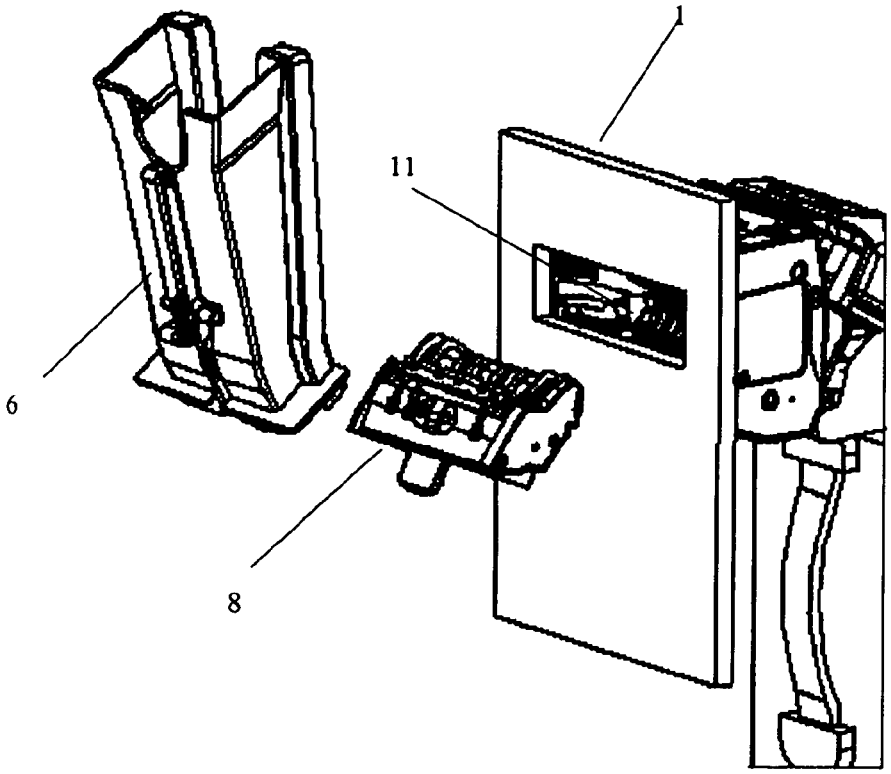
FIG. 3 illustrates removal of an input tray and the cartridge to allow access to the document path.

Another aspect of the disclosure addresses removal of jammed bills by providing a removable portion of the bill path in the form of a cartridge 8 (see FIG. 2A) that comprises part of the transport mechanism of the bulk feeder module 7. The cartridge 8 can be made sufficiently small that it can be removed through a small opening 11 of the door 1 or a wall of a safe (see FIG. 3), while maintaining the cash stored in the cash box 4 secured within the safe, without having to open the door of the safe. Preferably, the opening 11 is smaller than the validator unit or the acceptor module 3 so that they cannot be removed from the safe through the opening. Removal of the cartridge allows a jammed document to be cleared by an operator who does not have the authority to open the door to the safe. This can provide an improvement over some known implementations in which the door of the safe has to be opened and the entire validator section has to be extracted in order to clear a jammed bill. Such implementations present risks of easier access to cash stored in the cash box and requires an employee with greater privileges (i.e., greater authority) than most users.

Figure 4:
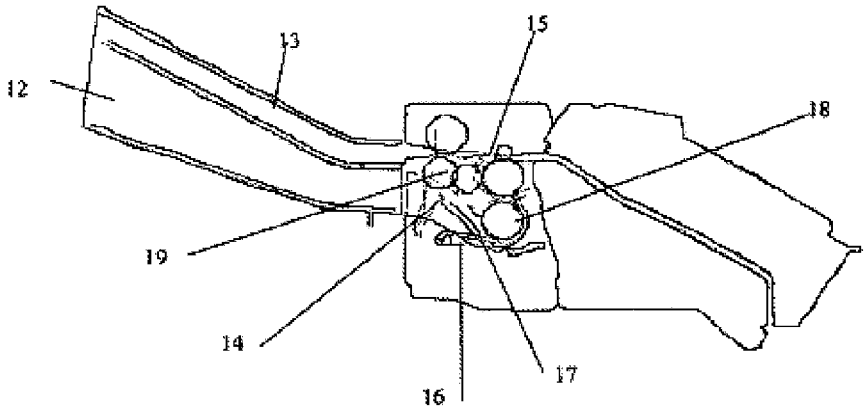
FIG. 4 is a side cut-away view illustrating various features of the bulk feeder module.

As illustrated in FIG. 4, the input tray 6 has two levels that define two bins. In the illustrated example, the lower bin 12 is for an input bundle of notes and the upper bin 13 is for rejected notes. The notes are manually deposited in, or withdrawn from, the appropriate bin by an operator such as a cashier. A rotatable protective cover can be included over the upper bin 13 to reduce the likelihood of removal of notes by unauthorized persons.

The bulk feeder module 7 includes control means comprising a microprocessor and sensors, as well as driving circuitry for a transport motor (see FIG. 16), and a set of light emitting diodes (LEDs) and a buzzer to provide a human-machine interface that also includes means (e.g., keypad) for entering information.

The bulk feeder module 7 is connected to the acceptor module 3 via an electric connection that provides power to the module and a serial communication link (RS232) coupled to the processor 100 (FIG. 16) in the acceptor module 3. The synchronized operation of the bulk feeder with the validator unit is achieved via a communication protocol between the control means (e.g., microprocessor) in the bulk feeder module 7 and control means (e.g., microprocessor) of the acceptor module.

Next, the operation sequence for the bulk feeder module and validator unit according to a particular implementation is described. The acceptor module 3, serving as the master unit, transmits commands to the bulk note feeder 7, and the bulk note feeder (serving as the slave unit) responds. The bulk note feeder 7 includes a processor 100 (FIG. 16) for communicating with the acceptor module, for monitoring its sensors, and for controlling its motor. The motor in the bulk note feeder module 7 has a tachometric wheel for monitoring the distance a note travels.

Figure 5:
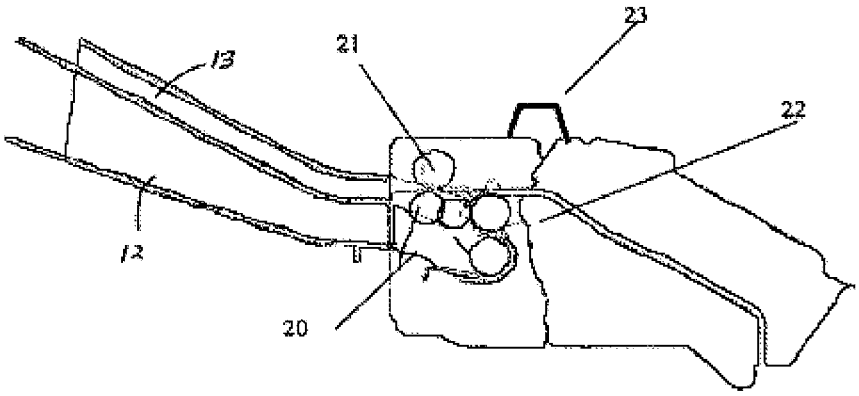
FIG. 5 is a side cut-away view illustrating the location of optical sensors in the bulk feeder module.

As shown in FIG. 5, the bulk note feeder 7 has three sensors: a first (bunch) sensor 20 for detecting the presence of a bundle of notes, a second (reject) sensor 21 for detecting the progress of a note being rejected (returned), and a third (progress) sensor 22 for monitoring the transport of a note through the bulk note feeder. The sensors 20, 21, 22 are used to monitor the position of the banknote along the document path in the bulk feeder module 7. The reject sensor 21, in combination with the start sensor 20, also is used to detect the presence or absence of the cartridge 8.

The sensors can be implemented, for example, as optical sensors using prisms and light pipes, light sources and corresponding detectors. The general mode of operation of the sensors is based upon continuity of an optical path that is disrupted when the cartridge 8 is removed or when a document intersects the optical beam. The sensors are operated under control of the processor 102 (FIG. 16) in the control means of the feeder module 7, and their status is communicated to the control means of the acceptor unit 3 upon request from the acceptor unit's control means.

In addition to issuing commands, the acceptor module 3 continuously polls the bulk note feeder 7 to retrieve the status of the various sensors 20, 21, 22 and the motor.

The bulk note feeder module 7 has at least the following two operating modes: an accept document mode and a reject document mode.

Figure 6:
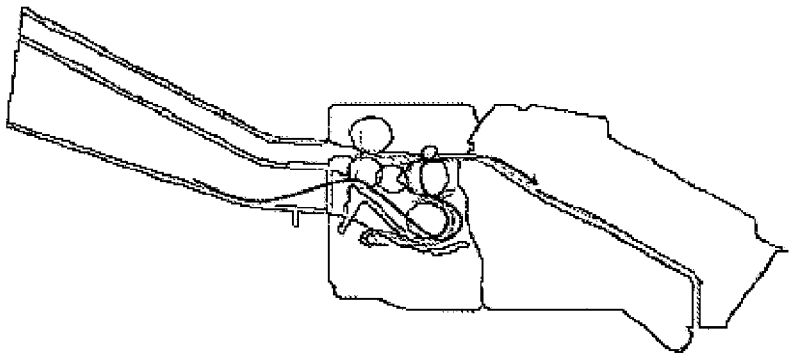
FIG. 6 shows the path of a note inserted in the bulk feeder module and transported to the acceptor unit.

The process of accepting a document begins when a bundle of notes is inserted into, or placed on, the input bin 12 of tray 6. The acceptor module 3 communicates with the bulk note feeder 7 and, through a polling process of the sensors, detects that the bunch sensor 20 has been activated. When that happens, the acceptor module 3 starts its transport motor and commands the bulk note feeder 7 to turn on its motor. This causes a note to be stripped from the bundle in the tray 6 and fed through the bulk note feeder 7 into the acceptor module 3. Any subsequent note is prevented from moving past the acceptor module's start sensor (that is, a subsequent note is prevented from entering the acceptor module) by turning off the bulk note feeder's motor. The stripped note continues to travel through the acceptor module 3, which checks and determines the note's denomination and authenticity, and is transported to the acceptor module's escrow position where it is processed and then accepted for movement into the cassette 4 or returned via the bulk note feeder's reject path according to a command from the host system. If the note is accepted and additional notes are present in the bulk note feeder 7, then the acceptor module 3 turns on its transport motor and commands the bulk note feeder 7 to turn on its motor. A note staged at the acceptor module's start sensor is brought into the acceptor module; at that time, any subsequent notes are prevented from entering the acceptor module. FIG. 6 shows the path of the note inserted in the bulk feeder 7 going to the acceptor unit 3.

Figure 7:
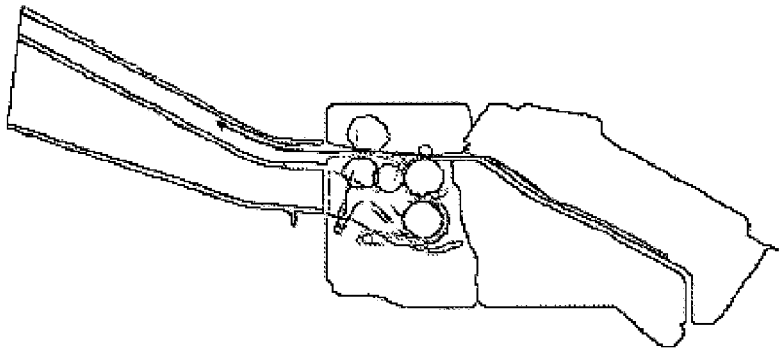
FIG. 7 shows the path of a note being returned.
Figure 9:
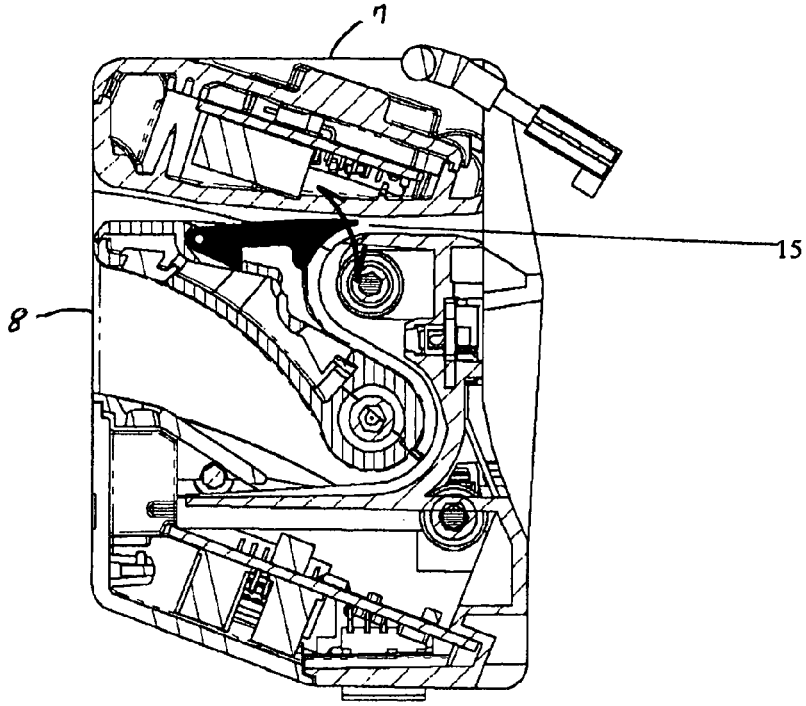
FIG. 9 shows a cut-away view illustrating various features of the bulk feeder module.
Figure 10:
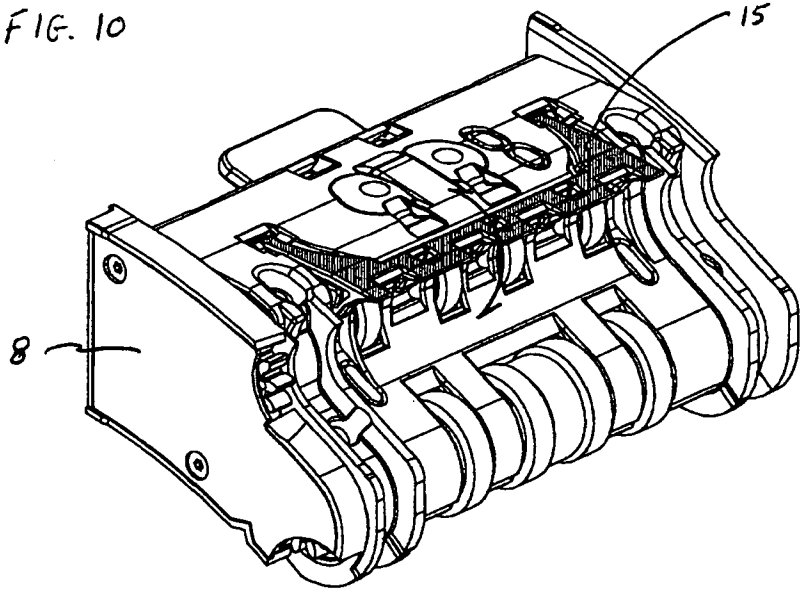
FIG. 10 is a perspective view of the removable cartridge.

The bulk feeder 7 includes a passive diverter 15 (see FIGS. 4, 9 and 10) to direct rejected notes to the reject bin 13 of the input/output tray 6. The diverter can be active or tensioned. When at rest, the diverter 15 is in a reject position, and is lifted by an incoming note to configure the document path to feed the note to the acceptor unit 3. The diverter 15 returns to the rest position by gravity once the note has cleared the location. The diverter 15 is attached to the removable cartridge 8. When a note is rejected, it is returned back through the entry slot of the acceptor module 3, and the diverter 15 configures the document path to return the note to the reject bin 13. FIG. 7 shows the path of a rejected note being returned.

When a note is rejected by the validator (e.g., because it is not recognized as an authentic note) and is to be returned, the acceptor module 3 commands the bulk note feeder 7 to turn on its motor in reverse for a short distance or until the progress sensor 22 becomes clear. This ensures that any note in the bulk note feeder 7 has moved back away from the diverter gate 15. This allows the diverter gate 15 to drop, thereby opening the bulk note feeder's reject path. The acceptor module 3 then turns on its transport motor in reverse and commands the bulk note feeder 7 to turn on its own motor in reverse so that the note is returned via the bulk note feeder's reject path. The bulk note feeder's reject sensor 21 is used to monitor the progress of the rejected note.

Next, the mechanical operation of the bulk note feeder module 7 is described. A bundle of notes is deposited in the input bin 12 of the tray 6, for example, with the short edge of the notes facing toward validator unit. The tray 6 is removably attached to the safe or to the bulk feeder itself 7 through the opening 11 in the safe. The bulk note feeder module 7 includes a document transport mechanism. In the illustrated example, one end of the bundle of notes is lifted against a feeder pulley 19 by a feeder pinch arm 14 (see FIG. 4). The feeder pinch arm 14 applies pressure when notes are inserted into the tray 6 and retracts when the module 7 is in the note reject mode and when the input tray is emptied. The feeder pulley 19 pulls the banknote on top of the stack using friction. At this stage, it is possible that multiple notes are stuck together and are pulled into the module 7. The note(s) is fed between a high friction drive pulley 18 and one or more stripper belts 17. The stripper belts are tensioned by a belt tensioner 16 which prevents any other notes from sticking to the top banknote. The high friction pulley 18 maximizes the traction on the top note while the belts 17 act like a band brake resisting the movement with lower friction on the opposite side of the document. The friction differential allows multiple notes to be separated while allowing the top note to move forward along the transport path. As the top note continues along the document path (see FIG. 6), the diverter gate 15 (FIGS. 4, 9 and 10) is lifted, and the note then is transported to the acceptor module 3.

Figure 11:
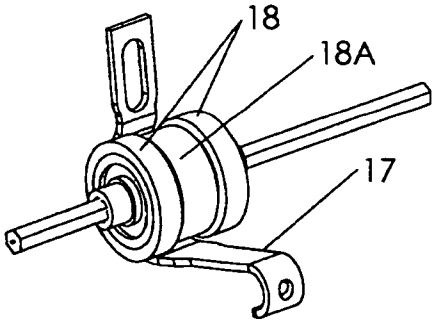
FIG. 11 shows an implementation of a banknote separator using belt and idler pulley and drive wheels.

In some implementations, the banknote separator includes two drive points on a drum-like arrangement. One such drive point is shown in FIG. 11. The belt 17 is either stationary and under tension, as in the preferred implementation, or may be driven backwards in an alternate implementation. The feeder pulley 19 intermittently or continuously pushes the bundle into the high friction wheel and belt interface. The higher friction of the drive wheel 18 relative to the friction of the belt 17 allows the drive wheel to drive a document around the drum. The friction of the belt 17 in relation to the friction of the documents allows the belt to prevent forward movement of any additional documents that are in contact with the belt when a previous document is currently occupying the drive wheel. An idler wheel 18A, or sleeve, keeps the belt 17 relatively tangent to the drive wheels 18 in order to provide a good pinch point for drawing the documents in.

Figure 12:
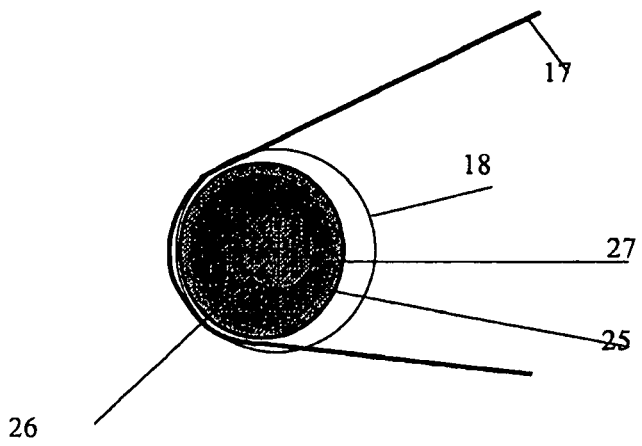
FIG. 12 illustrates an implementation of a banknote separator using an eccentric idler wheel.

In an alternative implementation (FIG. 12), the idler wheel 25 is mounted on an eccentric section of the drum arrangement. This causes the belt 17 to vibrate the bundle and eases the separation of sticky banknotes.

Figure 13:
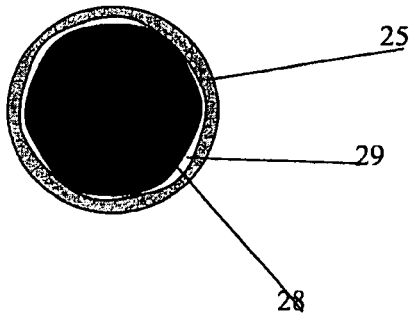
FIG. 13 illustrates an implementations of a banknote separator with a polygonal shaft in a polygonal bore of the idler wheel.

In another alternative implementation (FIG. 13), the vibration of the idler wheel 25 and the belt 17 is achieved by a non-circular, substantially polygonal-like shaft spinning in a non-circular, substantially polygonal-like sleeve on the idler wheel. When no note is at the belt/wheel interface, the idler wheel 25 is maintained idle by the friction of the belt 17. When a note is sufficiently engaged between the belt 17 and the idler wheel 25, the idler wheel spins with the shaft.

The bulk note feeder 7 also includes circuitry to produce an audible alarm and includes a green (or other color) LED that, under control of the acceptor module 3, indicate various conditions of the system. Such conditions include whether or not the system is enabled, whether or not the cassette or cartridge is installed, whether a fault was detected, or whether a banknote jam exists.

Preferably, the tray 6 is installed into openings in the door or outer wall 1 of the safe (see FIG. 3) because it allows easy access to other elements of the system such as the cartridge 8 and provides easy access to clear a jam and to perform other maintenance service in the bulk note feeder module without opening the safe. In that case, it is desirable to provide openings large enough to insert a banknote, but not too large to prevent unauthorized access to cash through these openings. In other implementations, the tray can be connected to apertures located in a wall inside of the safe other than the door or outside walls or an aperture in a bracket connected to the bulk note feeder module.

Figure 14:
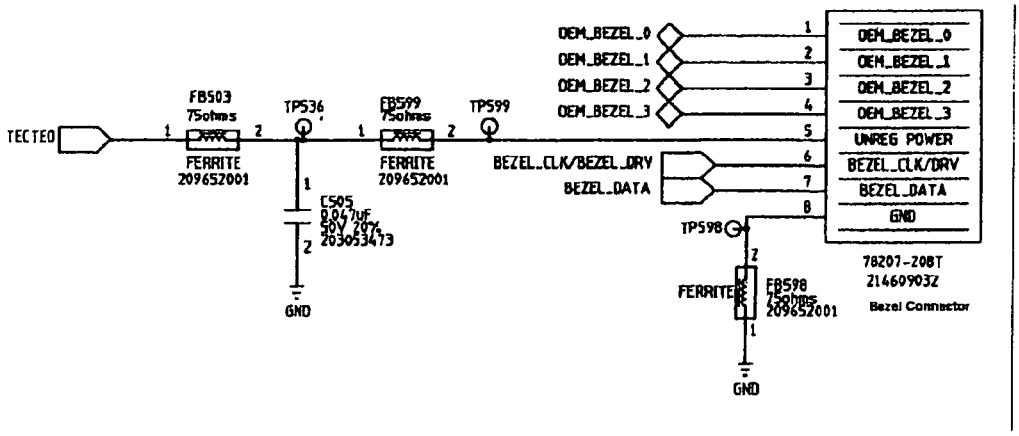
FIG. 14 is a schematic of a standard bezel connector.
Figure 15:
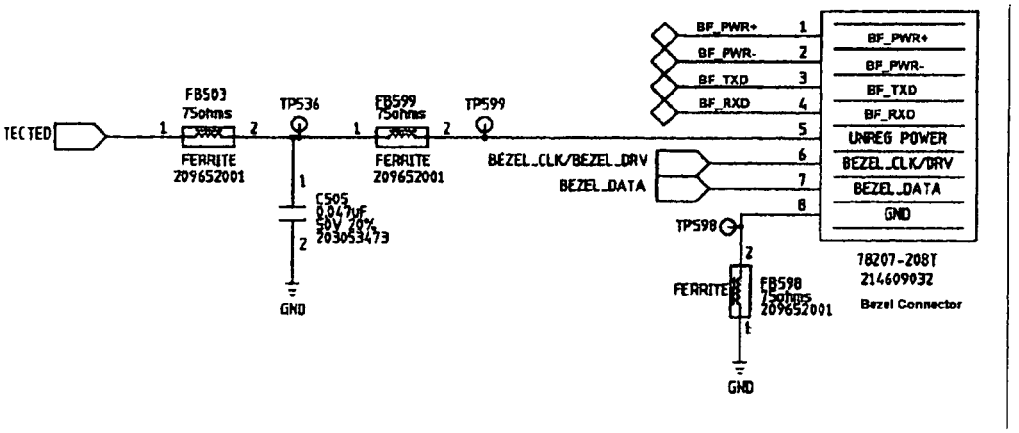
FIG. 15 is a schematic of the bezel connector re-configured for use with the bulk feeder module.

Next, the electrical and mechanical connection of the bulk note feeder module 7 to a validator unit is described. A standard note acceptor unit may include a connector designed to provide power and control lines to an active bezel that includes, for example, flashing LEDs. A pin allocation of an MEI Cashflow SC66/83 bill validator unit is illustrated in FIG. 14. The four lines labeled OEM_BEZEL_n can be reconfigured for the bulk note feeder module 7 as illustrated in FIG. 15. Thus, pins 1 and 2 can be used to provide power, and pins 3 and 4 can be used for transmitting and receiving data (TXD and RXD) of a universal asynchronous receiver/transmitter (UART) for the serial communication between the bulk feeder 7 and the acceptor module 3.

Once the bulk note feeder module 7 is installed, the acceptor module 3 auto-detects the presence of the bulk note feeder. For example, in a particular implementation, when the bulk banknote feeder is powered up, it periodically transmits a synchronization character to the bill validator unit. When the bill validator unit detects the character, it completes the synchronization process, and communication between the two devices begins. If the bulk note feeder 7 is not attached to the acceptor module 3, the acceptor module operates as a standard bill acceptor. The acceptor module 3 preferably maintains a copy of the bulk note feeder's processor 102 (FIG. 16) code. When a bulk note feeder module 7 is detected, the acceptor module 3 verifies the processor's 100 (FIG. 16) code for controlling the module and, if necessary, replaces it by downloading program code for the feeder module to memory in the module 7.

The bulk note feeder 7 can be retrofitted in the field by replacing the system harness that connects the bill validator to the host system. The new harness routes the communication signals and power lines to the front bezel connector, as illustrated in FIG. 16. The bulk note feeder 7 can be attached to the acceptor module 3 using two screws 9 or other mounting means (see FIG. 2). The communications cable 23 is attached between the acceptor module's front bezel connector and the bulk note feeder (see FIG. 5). The connection to the bezel connector, located at the front of the acceptor module 3, is convenient because of its proximity to the bulk note feeder 7, which implies a relatively short connection. Alternatively, as is apparent from FIG. 16, the bulk note feeder 7 can be connected at the rear of the acceptor module 3 or at the rear of the interface module.

Figure 8:
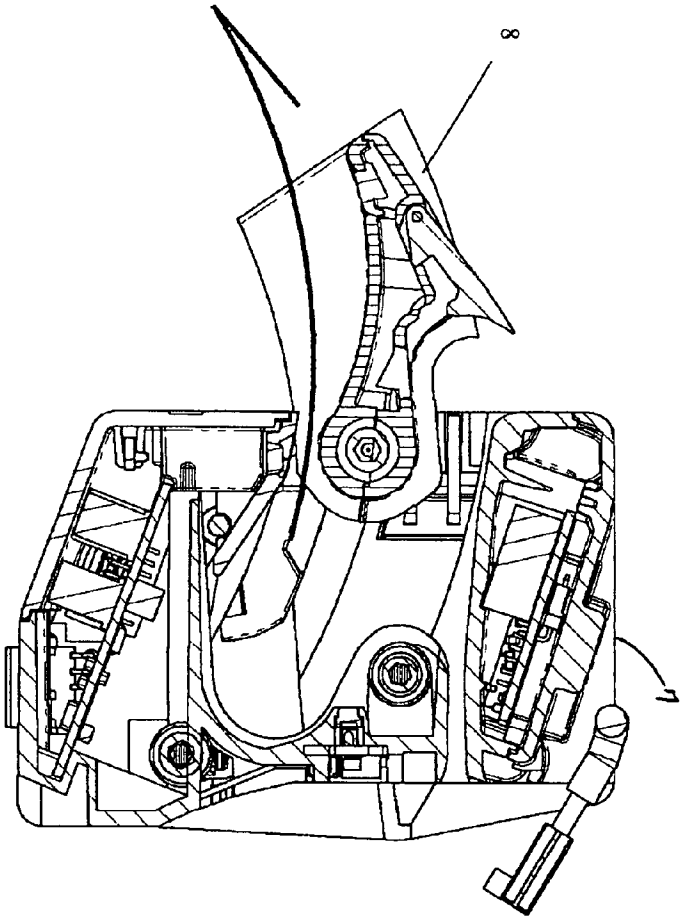
FIG. 8 is a cut-away view of the removable cartridge partly extracted from the bulk feeder module.

Removing the cartridge 8 from the bulk note feeder 7 (see FIGS. 2, 3 and 8) allows access to the bulk note feeder's note path for purposes of clearing any jammed notes. Thus, for example, if a note becomes jammed in the feeder module 7, the input/output tray 6 is removed from the door 1 of the safe, and the cartridge 8 is detached and withdrawn from the feeder module 7 through the small opening 11 in the door or wall of the safe (see FIG. 3). The jammed object can be cleared from the bulk document feeder module, and the cartridge and the input tray are re-installed in place in a reversed sequence.

Other implementations are within the scope of the claims.

What is claimed is:

1. An apparatus comprising a bulk document feeder module removably coupled to a document acceptor, the document acceptor comprising a first processor, wherein the bulk document feeder module is operable, when attached to the document acceptor, to feed one document at a time, from a bundle of documents, to the document acceptor, wherein the bulk document feeder module comprises a second processor electrically coupled to the first processor, and a document transport mechanism, a portion of which includes a removable cartridge.

2. The apparatus of claim 1 wherein the cartridge is removable to enable clearing of a jam in a document path.

3. The apparatus of claim 1 including electrical connections between the bulk document feeder module and the document acceptor, wherein the connections include means for providing power to the bulk document feeder module and means for communicating with the bulk document feeder module.

4. The apparatus of claim 3 wherein the communication means is operable according to a serial communication protocol.

5. The apparatus of claim 1 wherein the bulk document feeder module is operable to act as a slave module of the document acceptor, which is operable to act as a master module.

6. The apparatus of claim 1 wherein the second processor of the bulk document feeder module comprises a microprocessor and program memory, and wherein the document acceptor is operable to download a program for controlling the bulk document feeder module to the program memory.

7. The apparatus of claim 1 wherein the bulk document feeder module comprises a plurality of sensors to detect a status of a document in the document path.

8. The apparatus of claim 7 wherein the sensors comprise optical sensors.

9. The apparatus of claim 1 wherein the document transport mechanism comprises a motor which is operable to be turned on or off by command of the document acceptor.

10. The apparatus of claim 1 further comprising a tray to receive a bundle of documents, wherein the tray is mounted adjacent a front of the bulk document feeder, which is operable to strip one document at a time from the bundle of documents in the tray and to feed the stripped document to the document acceptor.

11. The apparatus of claim 1 further comprising a safe having a door with an opening, wherein the bulk document feeder module and document acceptor are located within the safe, and wherein the cartridge is removable through the opening in the door of the safe without having to open the door.

12. The apparatus of claim 11 wherein the size of the opening in the door of the safe is sufficiently small that neither the bulk document feeder module nor the document acceptor can be removed from the safe through the opening.

13. The apparatus of claim 1 wherein the bulk document feeder module is mechanically and electrically connected to the document acceptor and comprises:

a first document path and a second document path, a transport mechanism to move a document along one of the document paths depending on whether the document is traveling through the bulk document feeder module in a first direction or a second direction, one or more sensors to detect a status of a document in the bulk document feeder module, a diverter having a first position and a second position, wherein, when a document is transported in the first direction through the bulk note feeder module, the diverter is operable to move to the second position, and when a document is transported in the second direction, the diverter remains in the first position, and the second processor to communicate with the document acceptor, to monitor the sensors, and to control the transport mechanism.

14. The apparatus of claim 13 comprising a detachable input/output tray for receiving documents, wherein the tray is attached adjacent an entry for a document path in the bulk document feeder module.

15. The apparatus of claim 14 wherein the first document path is for transporting a document from an input bin of the tray to the document acceptor, and the second document path is for transporting a document from the document acceptor to an output bin of the tray.

16. The apparatus of claim 14 wherein the tray is attached to a wall of a safe that houses the document acceptor and the bulk document feedback module.

17. The apparatus of claim 1 wherein the bulk document feeder module comprises: a first document path and a second document path, a transport mechanism to move a document along one of the document paths depending on whether the document is traveling through the bulk document feeder module in a first direction or a second direction, a diverter having a first position and a second position, wherein, when a document is transported in the first direction through the bulk note feeder module, the diverter is operable to move to the second position, and when a document is transported in the second direction, the diverter remains in the first position, wherein the diverter forms part of the removable cartridge.

18. The apparatus of claim 1, the document feeder module including a document separator having a tensioned belt operable to contact an idler wheel when no document is present and having a high-friction wheel, wherein friction of the high-friction wheel on one side of a document is higher than the friction of the belt on the other side of the document when a document is present between the belt and the idler wheel.

19. The apparatus of claim 18 wherein the idler wheel is operable to serve as a sleeve on an eccentric shaft.

20. The apparatus of claim 18 wherein the idler wheel is a non-circular, substantially polygonal sleeve operable to spin about a non-circular, substantially polygonal shaft.

21. The apparatus of claim 1, wherein the bundle of documents includes banknotes.

22. An apparatus comprising a bulk document feeder module removably coupled to a document acceptor, the document acceptor comprising a first processor, wherein the bulk document feeder module is operable, when attached to the document acceptor, to feed one document at a time, from a bundle of documents, to the document acceptor, wherein the bulk document feeder module comprises a second processor electrically coupled to the first processor, the apparatus operable to transport a document in reverse if the document is rejected by the document acceptor, wherein the apparatus includes a tray mounted adjacent a front of the bulk document feeder module, the tray having a first bin for documents to be sent to the document acceptor and a second bin for documents returned by the document acceptor, and wherein the bulk document feeder module includes a diverter to route the rejected document to the reject bin.

23. An apparatus comprising a document validator operable to detect automatically whether a bulk document feeder module is coupled to the document validator, wherein the validator is operable to operate the bulk document feeder module if the validator detects the bulk document feeder module and is adapted to operate as a stand-alone document validator if the bulk document feeder module is not detected.

24. A method of upgrading a document validator, the method comprising attaching a bulk document feeder module to the document validator, and mechanically and electrically connecting the bulk document feeder module to an acceptor unit of the document validator, wherein the connecting of the bulk document feeder module comprises mounting an input/output tray adjacent to a document entry of the bulk document feeder module; wherein the document validator is operable to detect automatically whether the bulk document feeder module is coupled to the document validator, wherein the validator is operable to operate the bulk document feeder module if the validator detects the bulk document feeder module and is adapted to operate as a stand-alone document validator if the bulk document feeder module is not detected.

25. The method of claim 24 further comprising replacing a harness connecting the document validator to a host system to provide power and communication lines to the bulk document feeder module.

26. A method of clearing a jam in a bulk document feeder module connected to a document acceptor module installed in a safe, the method comprising:

detaching a document input tray;

withdrawing a removable cartridge from the bulk document feeder module through an opening in a door of the safe, clearing a jammed object from the bulk document feeder module, and re-installing the cartridge and the input tray in place in a reversed sequence.

* * * * *